United States Patent [19]

Sato

[11] 4,297,422

[45] Oct. 27, 1981

[54] ELECTROPHOTOGRAPHIC PROCESS FOR PRINTING A PLURALITY OF COPIES

[75] Inventor: Eiichi Sato, Tama, Japan

[73] Assignee: Olympus Optical Company Limited, Tokyo, Japan

[21] Appl. No.: 925,693

[22] Filed: Jul. 18, 1978

[30] Foreign Application Priority Data

Jul. 21, 1977 [JP] Japan ..... 52-87556

[51] Int. Cl.[3] ..... G03G 13/16; G03G 13/22; G03G 13/24

[52] U.S. Cl. ..... 430/54; 430/55; 430/97; 430/126; 355/3 DR

[58] Field of Search ..... 96/1 R, 1 TE, 1.1, 1.2, 96/1.5, 1.4; 430/126, 120, 104, 97, 55, 54; 355/3 D

[56] References Cited

U.S. PATENT DOCUMENTS

| | | | |
|---|---|---|---|
| 2,951,443 | 9/1960 | Byrne | 430/126 |
| 3,764,207 | 10/1973 | Obuchi | 430/126 |
| 3,877,934 | 4/1975 | Schmidlin | 96/1.4 |
| 3,918,971 | 11/1975 | Zweig | 430/126 |
| 3,941,592 | 3/1976 | Kawabata | 96/1.4 |
| 3,954,463 | 5/1976 | Bhagat | 430/126 |
| 3,961,951 | 6/1976 | Mayer | 96/1.4 |
| 3,992,557 | 11/1976 | Kubo et al. | 96/1.4 |
| 4,014,605 | 3/1977 | Fletcher | 430/55 |
| 4,141,728 | 2/1979 | Hemphill | 430/126 |

FOREIGN PATENT DOCUMENTS 2151283 4/1972 Fed. Rep. of Germany .

*Primary Examiner*—Richard L. Schilling
*Assistant Examiner*—John L. Goodrow
*Attorney, Agent, or Firm*—Haseltine and Lake

[57] ABSTRACT

An electrophotographic process for printing a number of copies from a single electrostatic charge latent image once formed on a photosensitive member by projecting an optical image of a document to be copied comprises the following successive steps;

(a) a step for effecting a uniform primary electrification with one polarity for the photosensitive member;

(b) a step for forming on the uniformly charged photosensitive member, a primary electrostatic latent image corresponding to the image of the document by projecting the document image to the photosensitive member;

(c) a step for developing the primary latent image with opaque toner particles having charged in the other polarity to form on the photosensitive member a toned image;

(d) a step for placing a transfer member over a surface of the photosensitive member on which surface the toned image has been formed;

(e) a step for effecting a secondary electrification with the one polarity from a side of the transfer member and for effecting a secondary exposure also from the side of the transfer member with light which is substantially absorbed by the toners, while the transfer member being placed over the photosensitive member, to form on the photosensitive member a secondary electrostatic latent image corresponding to the primary latent image; and (f) a step for separating the transfer member from the photosensitive member to transfer the toner image onto the transfer member.

After the above steps have been completed the steps (c) to (f) are repeated successively for the secondary electrostatic charge latent image repeatedly formed on the photosensitive member so as to form a number of duplicated copies.

14 Claims, 10 Drawing Figures

ELECTROPHOTOGRAPHIC PROCESS FOR PRINTING A PLURALITY OF COPIES

BACKGROUND OF THE INVENTION

The invention relates generally to an electrophotographic process, and more particularly to an electrophotographic process for printing a number of duplicated copies with a single imagewise exposure of a document to be duplicated.

Nowadays various processes have been developed for forming a number of copies from an electrostatic latent image once formed on a photosensitive member.

(i) The latent image is developed with toner particle developer and only a part of a toned image is transferred onto a transfer member such as a record paper. Then the development and transfer steps are repeated successively to obtain a plurality of copies.

(ii) After developing the electrostatic latent image with toner particles a part of the toned image is transferred to a record medium. Then a plurality of copies are formed by successively repeating an electrification step, a uniform exposure step, a development step and a partially transferring step.

(iii) A development step and a transfer step are repeated without destroying the electrostatic latent image on the photosensitive member to form a plurality of copies.

(iv) Prior to an electrification the photosensitive member is subjected to an imagewise exposure and a plurality of duplicated copies are obtained with utilizing a persistent conductivity of photosensitive material.

(v) The original image of the document is temporarily stored and a plurality of copies are printed with utilizing the stored original image as a secondary document.

(vi) After forming on the photosensitive member a highly insulating resin layer corresponding to the document plurality of copies are formed by repeating the electrification, uniform exposure, development and transfer steps successively.

The known process (i) has been disclosed in, for instance, a Japanese Patent Application Publication No. 30,233/69 (corresponding to U.S. patent application Ser. Nos. 537,964 and 538,038 filed on Mar. 28, 1966) and a Japanese Patent Application Publication No. 7,789/71. In the process of the Japanese Patent Application Publication No. 30,233/69 the electrostatic charge latent image once formed on an insulating member is developed with toners and the toned image is partially transformed onto a transfer member while a transfer potential is applied across the insulating photosensitive member and the transfer member in such a polarity that the toners are attracted to the transfer member. After the transfer step the latent image on the insulating member is again developed with toners and the toned image is transferred to another transfer member while applying the transfer potential which is higher than that applied is the previous transfer step. In this manner the transfer potential is made higher progressively during the formation of a plurality of copies.

In the electrophotographic process described in the Japanese Patent Application Publication No. 7,789/71 there is provided an external electric field control member for generating an electric field having a direction opposite to that of the electrostatic field between the transfer member and the latent image retaining member. Across the control member and the retaining member is applied a voltage of about 500 to 900 volts to maintain an electric stress at a separating point below a breakdown value of air. Thus after the toned image has been transferred the electrostatic latent image is remained on the image retaining member without being distorted so as to form a plurality of copies from the electrostatic latent image once formed on the image retaining member.

However the known processes have disadvantages that the toned image formed on the photosensitive member is not sufficiently transferred, but only partially transferred and thus the density or concentration of the duplicated image is low. In order to increase the copy density the higher transfer potential may be applied, but in this case the electrostatic charge latent image might be destroyed and thus distortion and over development might occur in the duplicated copies. Further the number of copies obtained from the single electrostatic image is limited to only about ten and even if various supplemental measures are taken, only 20 to 30 copies could be formed. Moreover the known processes are liable to be affected by humidity and although the transfer potential is not so high, charges due to the transfer bias pass through the transfer member and the photosensitive member is undesirably charged. Thus the fog becomes noticeable on the copies in accordance with the progress of the multiple duplication.

A known process belonging to the process (ii) has been disclosed in a Japanese Patent Application Laid-Open Publication No. 8,730/72. In this process an electrostatic charge latent image once formed on a photosensitive member is developed with a liquid developer and a toned image is partially transferred to a transfer web under pressure. Next the photosensitive member having a residual toner image is charged and then is subjected to a uniform exposure so as to discharge the electrostatic charges on exposed areas. The residual toner image is again made in contact with the liquid developer and the developed image is again partially transferred to another transfer web under pressure. A number of copies can be printed by repeating the above steps.

However in this known process since the charging and exposing steps are effected after the transfer step and thus an amount of residual toner particles is less, the potential at imagewise dark areas is decreased by the uniform exposure although the photosensitive member has been charged to a given potential. Therefore it is very difficult to obtain the duplicated copies having sufficiently high density. Moreover the partially residual toner image is used as a secondary original document and thus a gray tone might be possibly changed during a formation of a plurality of copies.

SUMMARY OF THE INVENTION

The present invention has for its object to provide a novel electrophotographic process which can obviate the above mentioned drawbacks of the known processes and can print a plurality of copies having high toner density and excellent half tone quality.

It is another object of the invention to provide en electrophotographic process in which a great number of copies can be formed without overdevelopment.

It is still another object of the invention to provide an electrophotographic process which is hardly affected by neither humidity nor resistance value of a transfer member.

An electrophotographic process according to the invention comprises (a) a step for effecting a uniform primary electrification with one polarity for a photosensitive member;

(b) a step for forming on the uniformly charged photosenstive member a primary electrostatic latent image corresponding to an image of the document by effecting the imagewise exposure;

(c) a step for developing the primary latent image with toner developer having charged in the other polarity to form on the photosensitive member a toned image;

(d) a step for placing a transfer member over a surface of the photosensitive member on which surface the toned image has been formed;

(e) a step for effecting a secondary electrification with the one polarity from a side of the transfer member and for effecting a secondary exposure also from the side of the transfer member, while the transfer member being placed over the photosensitive member, to form on the photosensitive member a secondary electrostatic latent image having an image information at least corresponding to the primary latent image; and (f) a step for separating the transfer member from the photosensitive member to transfer the toner image onto the transfer member;

whereby the steps (c) to (f) are repeated successively for the secondary latent image repeatedly formed on the photosensitive member to form a number of duplicated copies.

According to the invention the secondary electrification and secondary exposure may be successively or simultaneously.

In a preferred embodiment of the invention after the development the photosensitive member is subjected to a uniform exposure to weaken the attractive force of toner particles with respect to the photosensitive member.

DESCRIPTION OF THE PREFERRED EMBODIMENTS

Figure 1A:
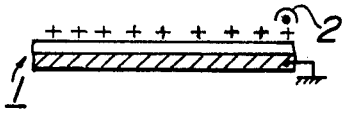
FIGS. 1*a* to 1*e* are schematic diagrams showing successive steps of an embodiment of an electrophotographic process according to the invention.
Figure 1B:
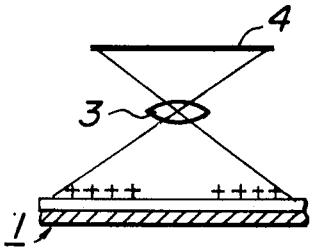

FIGS. 1*a* to 1*e* are schematic diagram showing successive steps of an embodiment of the electrophotographic process according to the invention. In this embodiment use is made of an insulating photosensitive member comprising a substrate of Al plate and a photosensitive layer of Se of a thickness of about 40 μm formed on the substrate by vacuum evaporation. As illustrated in FIG. 1*a* the Se layer of the photosensitive member 1 is uniformly charged in a positive polarity by a corona charger 2. Then the member 1 is subjected to an imagewise exposure by means of an optical system 3 to form a primary electrostatic charge latent image corresponding to a document 4 as shown in FIG. 1*b*.

Figure 1C:
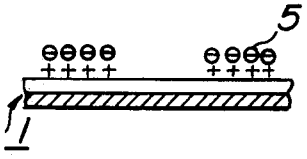
Figure 1D:
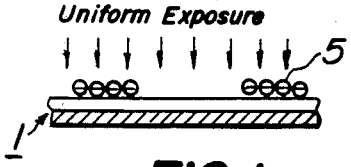

Next the primary latent image on the insulating photosensitive member 1 is developed with colored toner developer having charged in the negative polarity which is opposite to that of the primary latent image to form a visible image 5 on the photosensitive member 1 (see FIG. 1*c*). In the present embodiment then the photosensitive member is subjected to a uniform exposure from the side of the toned image 5 as shown in FIG. 1*d*. The intensity of this uniform exposure is made stronger than that of the imagewise exposure in the step shown in FIG. 1*b* to weaken an electrostatic attractive force of the toner particles to the photosensitive member 1.

Figure 1E:
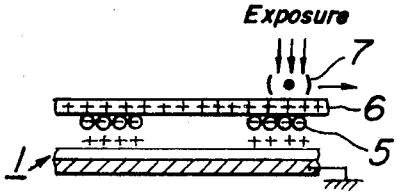

Then a transfer member 6, in this embodiment a translucent plain paper is placed over the photosensitive member 1. As illustrated in FIG. 1*e* the photosensitive member 1 is charged through the transfer member 6 by a corona charger 7 in the positive polarity which is same as that in the uniform charging step shown in FIG. 1*a*. At the same time the photosensitive member 1 is uniformly exposed from the side of the member 6. During this step almost all of the toner image 5 is attracted to the plain paper 6 by means of electrostatic attraction force and on that part of the photosensitive member 1 which situates underneath the toned image 5 is deposited a given amount of charges which is substantially same as that of the dark areas in the primary electrostatic charge image formed in the step of FIG. 1*b*. On the other hand on brightly exposed areas of the photosensitive member 1 there is not deposited any charge. The light for use in the step shown in FIG. 1*e* should have a wavelength which is substantially absorbed by the toner particles.

Then the plain paper 6 is separated from the photosensitive member 1 so as to transfer the toned image 5 onto the paper 6 and at the same time a secondary electrostatic charge latent image is reformed on the photosensitive member 1. The toned image transferred to the paper 6 may be fixed by an ordinary fixing step to form a final duplicated copy.

By repeating the above mentioned steps shown in FIGS. 1*c* to 1*e* successively a plurality of copies may be printed.

The inventors have conducted experiments in accordance with the process explained above and fifty copies having sufficiently high density could be obtained from the single primary charge image once formed on the photosensitive member 1. The quality of image of the fiftieth copy was almost same as that of the first copy. It was found that a number of excellent copies could be obtained in regardless of resistance values of the plain papers and even under the high humidity condition.

It was also found that if the exposure in the step of FIG. 1*e* is too strong, a sufficient amount of toner particles are not deposited on the member 1 during the next development step, while if the exposure in FIG. 1*e* is too weak, the overdevelopment might occur. Moreover if the corona voltage of the corona charger 7 in the step of FIG. 1*e* is too low, the density of the toned images was found to be decreased.

Figure 2A:
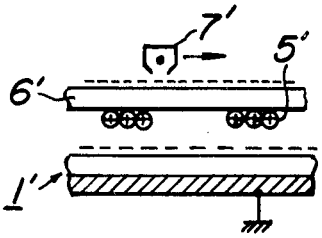
FIGS. 2*a* and 2*b* are schematic diagrams illustrating successive steps of another embodiment of the electrophotographic process according to the invention.
Figure 2B:
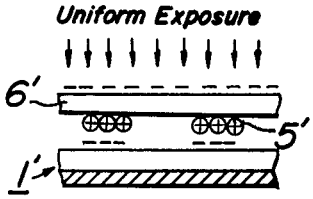

FIGS. 2*a* and 2*b* are schematic diagrams showing successive steps in another embodiment of the invention. In this embodiment as the photosensitive member use is made of a transparent photosensitive sheet 1' comprising a transparent sheet of organic material, a transparent conductive layer coated on the sheet, a Se layer of a thickness of about 0.6 μm and an insulated layer of a thickness of about 20 μm applied on the Se layer by spraying PVK solution solved in monochlorobenzene and toluene.

In the similar steps shown in FIGS. 1*a* to 1*d* a primary toned image is formed on the photosensitive member 1'. It should be noted that the primary uniform electrification is effected in the negative polarity and thus the development is carried out with the toner particles having charged in the positive polarity. Further the uniform exposure is effected after the development from the side of the member 1' opposite to the PVK layer through the transparent sheet and the transparent conductive coating of the photosensitive member.

Then as shown in FIG. 2a over the insulating photosensitive member 1' having the toned image 5' is placed a transparent sheet 6' as a transfer member and negative charges are applied from the side of the sheet 6' by means of a corona charger 7' as to attract the toned image 5' to the transparent sheet 6'.

Then the uniform exposure is effected from the side of the transparent sheet 6' while placing it over the member 1' so as to retain the charges on the member 1' underneath the toned image 5'. Next the sheet 6' is separated from the photosensitive member 1' to transfer the toned image onto the sheet 6'. Also in this embodiment the successive steps after the development are repeatedly effected to form a plurality of copies.

According to the process explained above with reference to FIGS. 2a and 2b a number of copies of high density and equal quality could be obtained without being affected by humidity. Since the transfer sheet 6' is transparent the intensity of the uniform exposure in FIG. 2b is preferable to be substantially equal to that of the imagewise exposure.

In the embodiments explained above the exposure after the secondary electrification is effected uniformly while the transfer member is placed over the photosensitive member, but this exposure may be carried out in an imagewise manner corresponding to another document. In such a case it is possible to obtain copies except for the first copy, which copies consist of a superimposed image of the original document and said another document.

After the given number of copies have been printed the insulating photosensitive member may be cleaned in a usual manner so as to prepare for a next painting operation.

Figure 3:
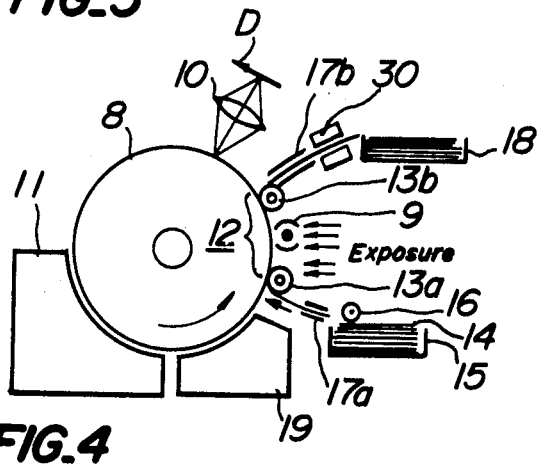
FIGS. 3, 4 and 5 show schematically three embodiments of an electrophotographic apparatus for carrying out the process according to the invention.

FIG. 3 shows schematically an embodiment of an electrophotographic apparatus for carrying out the process according to the invention. According to this embodiment the insulating photosensitive member is formed as a drum 8 which is rotated in the direction indicated by an arrow. While the photosensitive drum 8 is rotated it is charged uniformly in one polarity by means of a direct current corona charger 9. In this embodiment this corona charger 9 is commonly used as a transfer corona charger for transferring a toned image to a transfer member as will be explained hereinafter.

Then a light image of a document D to be duplicated D is projected via an optical system 10 to the photosensitive drum 8 to form a primary electrostatic charge latent image thereon. The drum 8 is further rotated to reach a development section 11 where the latent image is developed with toner developer having charged in the other polarity to form a toned image. This development may be effected either by a dry development or a liquid development. The toned image is then fed to a transfer section 12. In the transfer section are provided the corona charger 9 and a pair of feed rollers 13a and 13b arranged on respective sides of the charger 9.

There is further proved a paper cassette 15 in which plain papers 14 are piled. The paper is fed one by one by means of a sheet feed roller 16 in synchronism with the rotation of the drum 8 and is further fed through a paper guide 17a to the transfer section 12, in which the paper is fed with being in contact with the drum surface along its given arc determined by the feed rollers 13a and 13b. Then the paper is discharged via a paper guide 17b and a fixing section 30 to a tray 18.

In the transfer section 12 the drum 8 is first subjected to a uniform exposure, so that the attractive force of the toner particles to the drum is made weaker. Then the drum 8 is charged by the corona charger 9. During this charging operation the drum is exposed to a uniform light.

When the paper 14 is separated from the drum 8 the toner image which has been formed on the drum is transferred to the paper 14. The toned image on the paper is then fixed by the fixing device 30 to form a final copy.

The photosensitive drum 8 is further rotated over a plurality of revolutions and for each revolution the development section 11 and the transfer section 12 are made continuously operative to form a plurality of copies. It is found preferable that during the transfer step the corona voltage of the corona charger 9 is made higher than that in the uniform electrification. After the desired number of copies have been printed the drum 8 is cleaned by a cleaning section 19 arranged between the development section 11 and the transfer section 12 so as to complete a preparation for the uniform electrification for a next duplicating operation.

Figure 4:
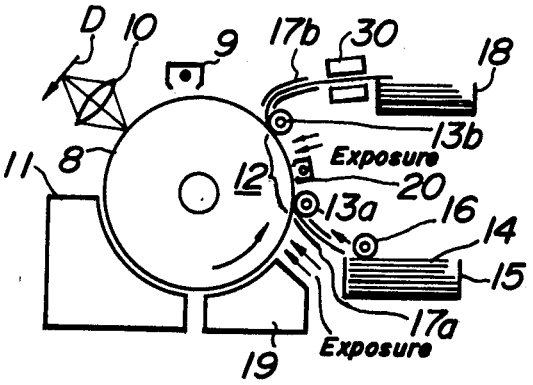

FIG. 4 is a schematic diagram for depicting another embodiment of the electrophotographic apparatus for carrying out the process according to the invention. The construction and operation of this embodiment are substantially similar to those of the previous embodiment except for the following points, i.e. separate corona chargers 9 and 20 are provided for the primary uniform electrification and the secondary electrification, respectively; the uniform exposure for decreasing the attractive force of toner developer to the drum 8 if effected between the development section 11 and the transfer section 12; and the secondary exposure for forming the secondary electrostatic latent image on the drum 8 is effected after the secondary electrification.

Figure 5:
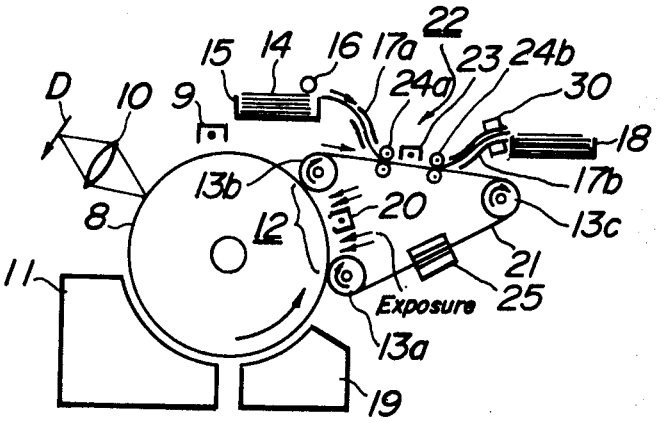

FIG. 5 is a schematic diagram showing still another embodiment of the electrophotographic apparatus for carrying out the process according to the invention. In this embodiment the toned image formed on the photosensitive drum 8 is once transferred onto a transfer sheet 21 and the toner image on the transfer sheet 21 is further transferred to the plain paper 14. The transfer sheet 21 is formed as an endless belt which is rotated in the direction shown by an arrow by means of feed rollers 13a, 13b and 13c. The sheet 21 is made of transparent material. The toned image on the sheet 21 is transferred to the paper 14 at a second transfer section 22 in which are arranged a corona charger 23 and a pair of feed rollers 24a and 24b positioned on respective sides of the corona charger 23. After passing through the transfer section 22 the transfer sheet 21 is cleaned by a cleaner 25.

In the apparatus illustrated in FIG. 5 since use is made of the transfer sheet 21 as an intermediate transfer member and this sheet 21 is cleaned after the toner image has been transferred to the paper 14, at the first transfer section 12 no image is existent other than the toned image formed on the drum 8. Therefore if the paper having the toner image transferred thereto and discharged on the tray 18 is once again fed to the second transfer section 22 after being turned over it is possible to effect printing on both sides of the paper 14. Further the transfer sheet 21 may be made sufficiently transparent and thus the excellent secondary electrostatic latent image can be formed on the drum 8.

As explained above according to the present invention the secondary electrostatic charge latent image of very high quality can be formed on the photosensitive member with the aid of the toned image of high density while the transfer member is placed over the photosensitive member and thus the electrostatic contrast of the secondary latent image can be made materially high. Therefore a number of duplicated copies of high quality and having high density can be printed from the single primary electrostatic charge image once formed on the photosensitive member without being affected by the humidity and the resistance of the transfer member.

What is claimed is:

1. An electrophotosensitive process for printing a plurality of copies with a single imagewise exposure of a document to be duplicated comprising (a) a step for effecting a uniform primary electrification with one polarity for a photosensitive member;

(b) a step for forming on the uniformly charged photosensitive member a primary electrostatic latent image corresponding to an image of the document by effecting the imagewise exposure;

(c) a step for developing the primary latent image with toner developer having charged in the other polarity to form on the photosensitive member a toner image;

(d) a step for placing a transparent or translucent transfer member over a surface of the photosensitive member on which surface the toned image has been formed;

(e) a step for effecting a secondary electrification with the one polarity by applying a transferring electric field from the side of the transfer member in such a manner that a potential at an imagewise dark portion on the photosensitive member on which portion the toner has been applied will assume a substantially same potential as that of the primary electrostatic latent image after a transfer and for effecting a secondary exposure with light having a wavelength which is substantially absorbed by the toner developer also from the side of the transfer member in such a manner that undesired charge applied at an imagewise bright portion on the photosensitive member is decayed, but the charge on the imagewise dark portion is not decayed due to the presence of the light impermeable toner so as to be able to form on the photosensitive member a secondary electrostatic latent image having an image information substantially corresponding to the primary latent image after the transfer, said secondary electrification and secondary exposure being simultaneously or successively effected, while the transfer member is placed over the photosensitive member; and (f) a step for separating the transfer member from the photosensitive member to transfer the toner image onto the transfer member;

whereby the steps (c) to (f) are repeated successively for the secondary latent image repeatedly formed on the photosensitive member to form a number of duplicated copies.

2. An electrophotosensitive process according to claim 1, wherein the exposure in the step (e) is uniformly effected to form the secondary electrostatic latent image which includes image information completely corresponding to the toned image formed in the step (c).

3. An electrophotographic process according to claim 1, wherein the exposure in the step (e) is effected in an imagewise manner corresponding to another document to form the secondary electrostatic latent image which corresponds to a superimposed image of the toned image and the image of said another document.

4. An electrophotographic process according to claim 1, wherein said electrification and exposure in the step (e) are effected simultaneously.

5. An electrophotographic process according to claim 1, wherein the electrification and exposure in the step (e) are effected successively in this order.

6. An electrophotographic process according to claim 1, wherein said transfer member is transparent.

7. An electrophotographic process according to claim 1, wherein said transfer member is translucent.

8. An electrophotographic process according to claim 6, wherein said transparent transfer member is an endless sheet and the toned image formed on the endless transfer sheet is further transferred to a record medium.

9. An electrophotographic process according to claim 8, further comprising a step for cleaning the endless transfer sheet after the toned image has been transferred to the record medium.

10. An electrophotographic process according to claim 7, wherein said translucent transfer member is a plain paper sheet.

11. An electrophotographic process according to claim 1, wherein said uniform primary electrification in the step (a) and the secondary electrification in the step (e) are effected by the same charging device.

12. An electrophotographic process accordng to claim 1, wherein the uniform primary electrification in the step (a) and the secondary electrification in the step (e) are carried out by separate charging devices.

13. An electrophotographic process according to claim 1, wherein the secondary electrification is effected to such an extent that the secondary electrostatic latent image has substantially same amount of charge as that of the primary electrostatic latent image.

14. An electrophotographic process according to claim 1, wherein as the photosensitive member use is made of a photosensitive drum comprising a rotatable drum body made of electrically conductive material and a photosensitive layer applied on a circumferential surface of the drum and the transfer member is travelled with being in contact with the photosensitive drum over a given arc of the circumferential passage of the drum.

* * * * *